US011603252B2

(12) United States Patent
Liu et al.

(10) Patent No.: US 11,603,252 B2
(45) Date of Patent: Mar. 14, 2023

(54) MICROWAVEABLE FOOD CONTAINERS AND FOOD PRODUCTS FOR HIGH-TEMPERATURE COOKING

(71) Applicant: Campbell Soup Company, Camden, NJ (US)

(72) Inventors: Hua Liu, Moorestown, NJ (US); Mark Robert Watts, Marlton, NJ (US); Brandon James Knapp, Hammonton, NJ (US)

(73) Assignee: Campbell Soup Company, Camden, NJ (US)

( * ) Notice: Subject to any disclaimer, the term of this patent is extended or adjusted under 35 U.S.C. 154(b) by 789 days.

(21) Appl. No.: 16/448,742

(22) Filed: Jun. 21, 2019

(65) Prior Publication Data

US 2019/0389643 A1 Dec. 26, 2019

Related U.S. Application Data

(60) Provisional application No. 62/688,519, filed on Jun. 22, 2018.

(51) Int. Cl.
*B65D 81/34* (2006.01)
*B65D 81/38* (2006.01)

(52) U.S. Cl.
CPC ..... *B65D 81/3446* (2013.01); *B65D 81/3869* (2013.01)

(58) Field of Classification Search
CPC ..... B65D 2581/3456; B65D 2581/346; B65D 81/3216; B65D 2581/3437; B65D 2581/3459; B65D 21/02; B65D 21/0233; B65D 81/3446; B65D 81/3869; B65D 43/0214; B65D 2205/00; B65D 81/3453
See application file for complete search history.

(56) References Cited

U.S. PATENT DOCUMENTS 2,591,578 A * 4/1952 McNealy ..... B65D 3/22 229/120.01
2,805,790 A * 9/1957 Smucker ..... B65D 1/265 206/520

(Continued)

OTHER PUBLICATIONS https://www.youtube.com/watch?v=fTjcliqR_Yc 1987 commercial for "Campbell's Cup." (Year: 2017).*

*Primary Examiner* — Don M Anderson
(74) *Attorney, Agent, or Firm* — Pauly, DeVries Smith & Deffner LLC

(57) ABSTRACT

Embodiments herein relate to microwaveable food containers and food products for high-temperature cooking applications and related methods. In an embodiment, a disposable microwaveable food container for high-temperature cooking applications is included. The container can include an inner cup including a bottom wall, a side wall connected to the bottom wall, the side wall comprising a top, and a top seal layer in contact with the top of the side wall. The bottom wall and side wall together can define a reservoir to hold a food material. An outer cover shell can include a bottom wall, a side wall connected to the bottom wall, a top wall connected the side wall, and a support structure for supporting the inner cup. The support structure can contact the inner cup and hold it in a position with a bottom gap, a side gap, and a top gap. Other embodiments are also included herein.

16 Claims, 8 Drawing Sheets

(56) References Cited

U.S. PATENT DOCUMENTS

| | | | | | |
|---|---|---|---|---|---|
| 2,828,903 | A * | 4/1958 | Adkins | B65D 77/0493 188/196 P |
| 3,618,848 | A | 11/1971 | Pawlowski et al. | |
| 4,348,421 | A * | 9/1982 | Sakakibara | A47J 47/14 426/112 |
| 4,478,349 | A | 10/1984 | Haverland, Jr. et al. | |
| 4,595,120 | A | 6/1986 | Logan et al. | |
| 4,661,672 | A | 4/1987 | Nakanaga | |
| 4,880,951 | A | 11/1989 | Levinson | |
| 5,252,793 | A | 10/1993 | Woods | |
| 5,263,777 | A | 11/1993 | Domke | |
| 5,674,546 | A | 10/1997 | Barnes et al. | |
| 7,051,762 | B2 * | 5/2006 | Haamer | B65D 81/3453 426/118 |
| 7,851,731 | B2 | 12/2010 | Ly | |
| 9,027,825 | B2 | 5/2015 | Baker et al. | |
| 9,199,781 | B2 | 12/2015 | Bosman | |
| 9,522,772 | B2 | 12/2016 | Fu et al. | |
| 2005/0077291 | A1 | 4/2005 | Baker | |
| 2005/0133500 | A1 | 6/2005 | Brooks et al. | |
| 2009/0297673 | A1 * | 12/2009 | Sebban | B65D 81/3453 219/731 |
| 2011/0042373 | A1 | 2/2011 | Moses et al. | |
| 2012/0061386 | A1 | 3/2012 | Parsons | |
| 2016/0122080 | A1 * | 5/2016 | Blatstein | B65D 21/0213 53/449 |

* cited by examiner

MICROWAVEABLE FOOD CONTAINERS AND FOOD PRODUCTS FOR HIGH-TEMPERATURE COOKING

This application claims the benefit of U.S. Provisional Application No. 62/688,519, filed Jun. 22, 2018, the content of which is herein incorporated by reference in its entirety.

FIELD

Embodiments herein relate to microwaveable food containers and food products for high-temperature cooking applications and related methods.

BACKGROUND

Rapid high-temperature cooking combining multiple ways of heating and cooking the food, including but not limited to microwave, convection, steam, and infrared heating, has been continuously gaining popularity in not only quick service restaurants but also full-service fine dining kitchen environments. This type of rapid cooking allows the preparation of high-quality food at high-speed, suiting the need of the fast pace modern day consumers.

A specific example of rapid cooking ovens includes combination microwave and convection ovens sold under the trademark TURBOCHEF®, which can be used to cook or reheat comestibles. Combination microwave and convection ovens for quick service food preparation applications commonly use both a source of radiant energy (such as microwave energy) and convection heating in an air medium to enable rapid and convenient cooking and heating of comestibles.

SUMMARY

Embodiments herein relate to microwaveable food containers and food products for high-temperature cooking applications and related methods. In an embodiment, a disposable microwaveable food container for high-temperature cooking applications is included. The container can include an inner cup including a bottom wall, a side wall connected to the bottom wall, the side wall comprising a top, and a top seal layer in contact with the top of the side wall. The bottom wall and side wall together can define a reservoir to hold a food material to be heated. The container can include an outer cover shell, the outer cover shell including a bottom wall, a side wall connected to the bottom wall, a top wall connected the side wall, and a support structure for supporting the inner cup. The support structure can contact the inner cup and hold it in a position with a bottom gap of at least about 0.05 inches between the bottom wall of the inner cup and the bottom wall of the outer cover shell, a side gap of at least about 0.05 inches between the side wall of the inner cup and the side wall of the outer cover shell, and a top gap of at least about 0.3 inches between the top seal layer of the inner cup and the wall of the outer cover shell.

In an embodiment, a microwaveable food product for high-temperature cooking applications is included. The food product can include an inner cup including a bottom wall, a side wall connected to the bottom wall, the side wall comprising a top, and a top seal layer in contact with the top of the side wall. The bottom wall and side wall together can define a reservoir to hold a food material to be heated. The container can include an outer cover shell, the outer cover shell including a bottom wall, a side wall connected to the bottom wall, a top wall connected the side wall, and a support structure for supporting the inner cup. The support structure can contact the inner cup and hold it in a position with a bottom gap of at least about 0.05 inches between the bottom wall of the inner cup and the bottom wall of the outer cover shell, a side gap of at least about 0.05 inches between the side wall of the inner cup and the side wall of the outer cover shell, and a top gap of at least about 0.3 inches between the top seal layer of the inner cup and the wall of the outer cover shell. The food product can include a food material disposed in the reservoir formed by the bottom wall and the side wall of the inner cup.

In an embodiment, a method of making a microwaveable food product for high-temperature cooking applications is included. The method can include placing food material into an inner cup, the inner cup including a bottom wall, a side wall connected to the bottom wall, the side wall comprising a top, and a top seal layer in contact with the top of the side wall, the bottom wall and side wall together defining a reservoir. The method can further include applying a lidding film to a top surface of the inner cup to seal the food material into the inner cup. The method can further include placing the filled inner cup into an outer cover shell. The outer cover shell the outer cover shell including a bottom wall, a side wall connected to the bottom wall, a top wall connected the side wall, and a support structure for supporting the inner cup. The support structure can contact the inner cup and hold it in a position with a bottom gap of at least about 0.05 inches between the bottom wall of the inner cup and the bottom wall of the outer cover shell; a side gap of at least about 0.05 inches between the side wall of the inner cup and the side wall of the outer cover shell; and a top gap of at least about 0.3 inches between the top seal layer of the inner cup and the wall of the outer cover shell.

In an embodiment, a method of preparing a microwaveable food product is included. The method can include inserting a microwaveable food product into a high-temperature, high-speed cooking oven. The food product can include an inner cup including a bottom wall, a side wall connected to the bottom wall, the side wall comprising a top, and a top seal layer in contact with the top of the side wall. The bottom wall and side wall together can define a reservoir to hold a food material to be heated. The container can include an outer cover shell, the outer cover shell including a bottom wall, a side wall connected to the bottom wall, a top wall connected the side wall, and a support structure for supporting the inner cup. The support structure can contact the inner cup and hold it in a position with a bottom gap of at least about 0.05 inches between the bottom wall of the inner cup and the bottom wall of the outer cover shell, a side gap of at least about 0.05 inches between the side wall of the inner cup and the side wall of the outer cover shell, and a top gap of at least about 0.3 inches between the top seal layer of the inner cup and the wall of the outer cover shell. The food product can include a food material disposed in the reservoir formed by the bottom wall and the side wall of the inner cup. The method can further include raising the temperature to at least 500 degrees Fahrenheit in less than 10 seconds after inserting the microwaveable food product into the cooking oven and initiating a cooking cycle. The method can further include holding the temperature at no less than 500 degrees Fahrenheit for a hold time of at least 20 seconds. The method can further include removing the food product from the cooking oven.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

Figure 1:
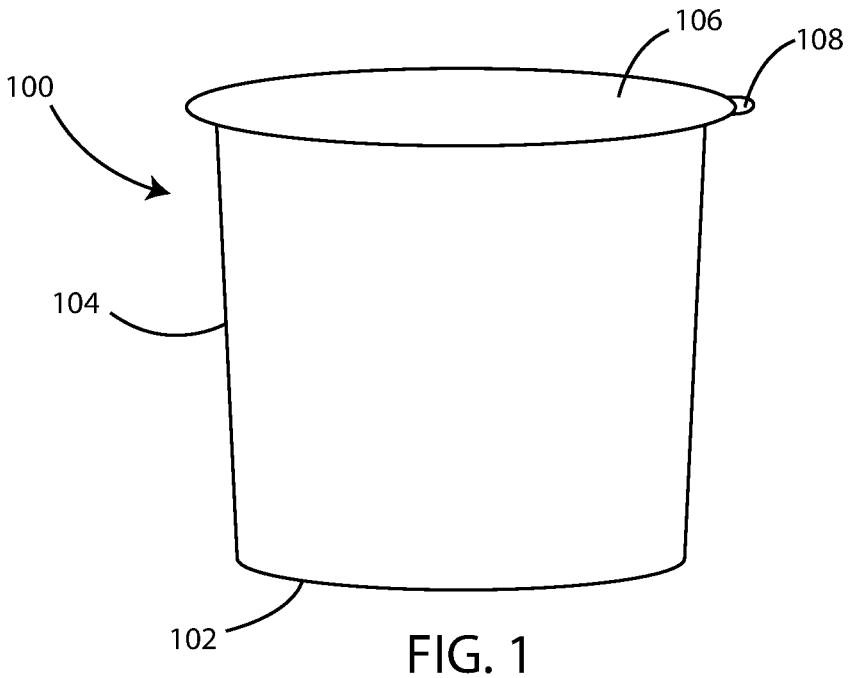
FIG. 1 is a schematic perspective view of an inner cup in accordance with various embodiments herein.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

Rapid high-temperature cooking ovens combine multiple ways of heating and cooking the food, including but not limited to microwave, convection, steam, and infrared heating. Rapid high-temperature cooking has been continuously gaining popularity in not only quick service restaurants but also full service fine dining kitchen environments. This type of rapid cooking allows the preparation of high quality food at high-speed, suiting the need of the fast-paced, modern-day consumers.

A specific example of high-speed, high-temperature cooking ovens includes combination microwave and convection ovens, such as those sold under the trademark TURBOCHEF®, to cook or reheat comestibles. Combination microwave and convection ovens use both microwave energy and convection heating to enable rapid and convenient cooking and heating of comestibles.

However, high-speed oven cooking has stringent requirements on the items that are inserted into the ovens. For example, they need to be compatible with the heating mechanisms used, e.g., metal utensils are in general not recommended to be used in high-speed oven operating modes that use microwave as one of the heating mechanisms, and they need to able to sustain ultrahigh cooking temperatures. Current food packaging for restaurant or home consumer applications, however, are typically disposable or single use in nature and usually do not meet with these requirements. Most current disposable containers can only be used in ambient temperatures of up to about 400° F. Those materials will melt or burn if subjected to the ambient environment of a combination microwave and convection oven, which typically holds at 480° F. or above. Thus, using them directly in the speed ovens could be very dangerous. In addition, transferring food products from the original package to the cooking utensils, and to the containers that the consumer will consume the food from are very necessary steps, although if not THE, one of the time consuming and highly inconvenient parts that can result in food waste, spills, and injury of the operators or consumers.

Embodiments herein allow the food content to be packed in at the food manufacturer, and then allows the direct cooking (in the packaging format it comes in) in high-speed, high-temperature ovens without the hassle of container transferring, and subsequently allows the consumers to directly consume food from the same container. Embodiments herein can provide protection from the extremely high temperatures in high-speed, high-temperature oven on the bottom, sides and top of a food package allowing the use of materials that would otherwise not be possible in such a harsh environment.

Referring now to FIG. 1, a schematic perspective view of an inner cup 100 in accordance with various embodiments herein. The inner cup 100 can include a bottom wall 102, a side wall 104 connected to the bottom wall 102, and a top seal layer 106 (or top wall) in contact with the top of the side wall 104. In some embodiments, the top seal layer 106 can also include a peel tab 108 attached thereto to aid in removal of the top seal layer 106 at or near the point of product consumption. Exemplary materials for the inner cup are described in greater detail below. The bottom wall 102 and the side wall 104 can together define a reservoir to hold a food product to be heated.

Figure 2:
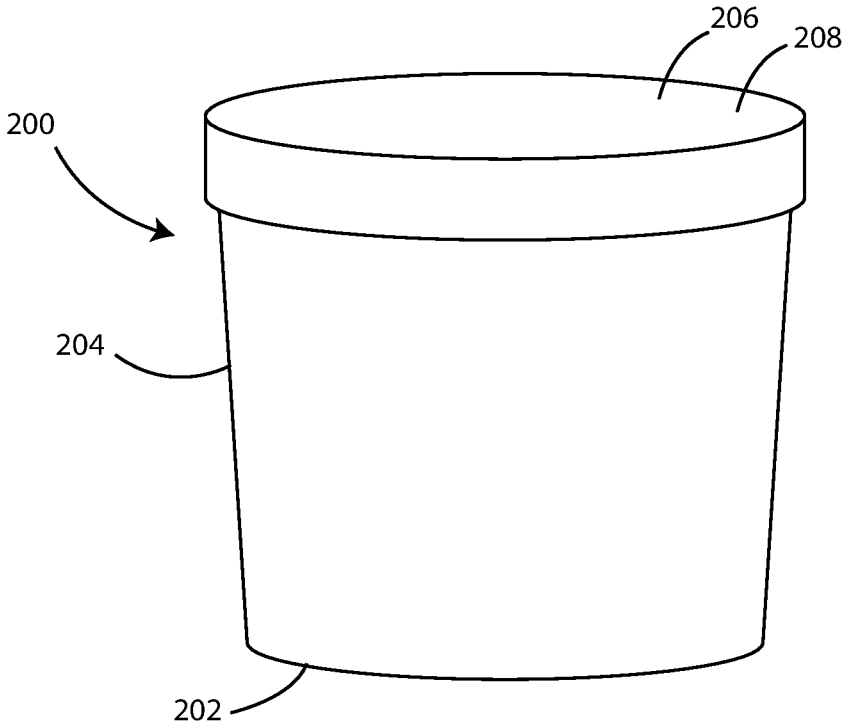
FIG. 2 is a schematic perspective view of an outer cover shell in accordance with various embodiments herein.

Embodiments herein can include an outer cover shell into which an inner cup can fit. Referring now to FIG. 2, a schematic perspective view of an outer cover shell 200 in accordance with various embodiments herein. The outer cover shell 200 can include a bottom wall 202, a side wall 204 connected to the bottom wall, and a top wall 206 connected to or disposed over a top portion of the side wall 204. In some embodiments, the top wall 206 can take the form of a removeable overcap 208. However, in other embodiments, the top wall 206 is permanently attached to the top wall 206. Exemplary materials for the outer cover shell are described in greater detail below.

The outer cover shell can provide protection for the inner cup. In specific, the inner cup can be fit into the outer cover shell in such a way that there is a gap (or separation, spacing, distance, or void) that is of a sufficient size that it provides insulation between the extremely high temperatures of the oven and the walls of the inner cup that can be damaged by exposure to such high temperatures. In many cases, the gap or separation can be filled with air. However, in some embodiments, the separation or gap can also be interrupted by other material layers such as an inner or intermediate wall. In some embodiments, the insulation properties provided by a bottom gap, a side gap, and a top gap are sufficient so as to prevent damage to the inner cup despite exposure of the outer cover shell to an air temperature of about 425, 450, 475, 500, 525, or 550 degrees Fahrenheit for about 15, 30, 45, 60, 75, 90, or 120 seconds.

Figure 3:
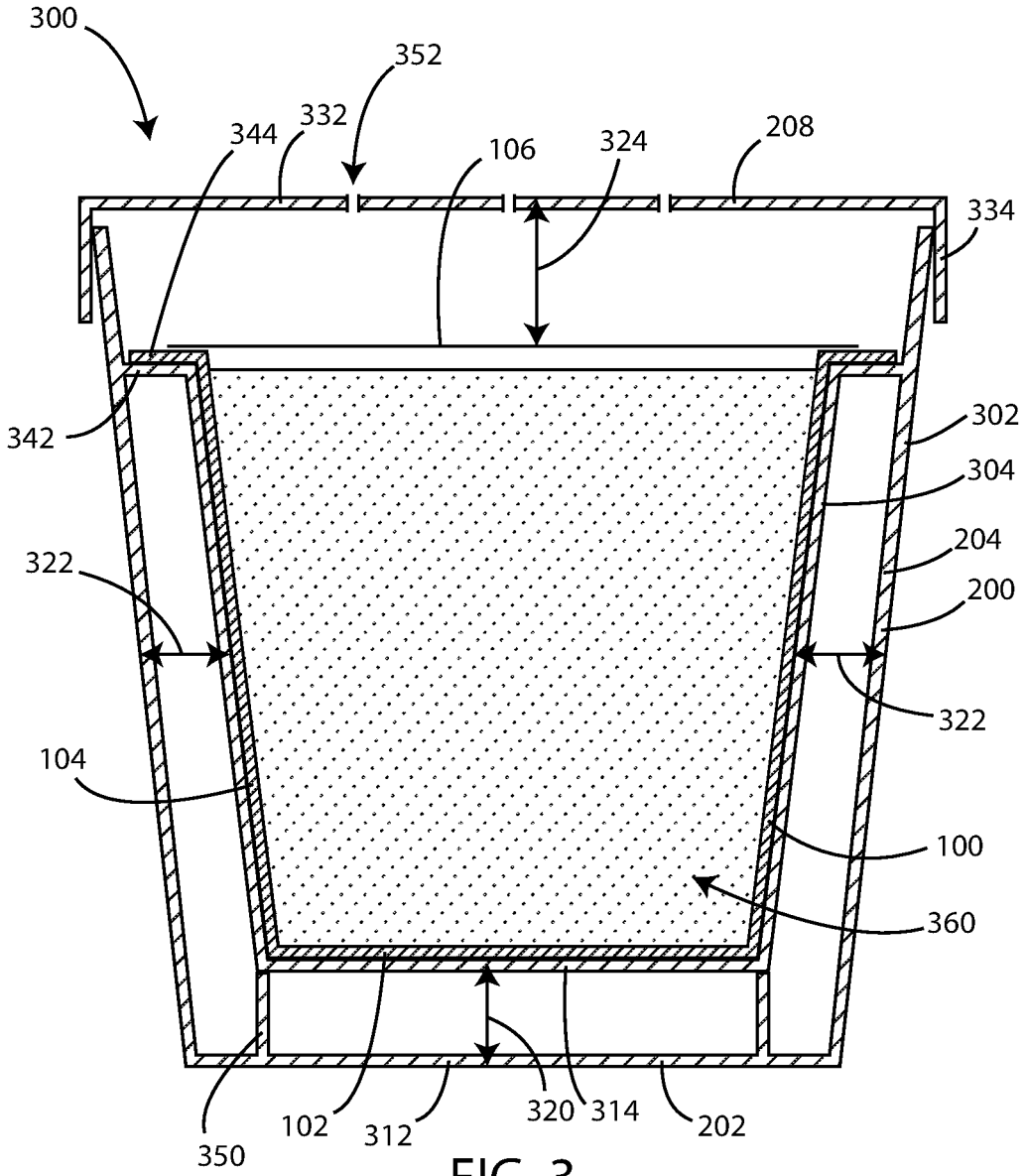
FIG. 3 is a schematic cross-sectional view of a disposable microwaveable container in accordance with various embodiments herein.

Referring now to FIG. 3, a schematic cross-sectional view of a disposable microwaveable container 300 in accordance with various embodiments herein. The disposable microwaveable container 300 can include an inner cup 100 and an outer cover shell 200. The inner cup 100 can include a bottom wall 102, a side wall 104, and a top seal layer 106. A food material 360 can be disposed within the inner cup 100. Exemplary food materials are described in greater detail below. The outer cover shell 200 can include a bottom wall 202, a side wall 204 connected to the bottom wall, and an overcap 208 disposed over a top portion of the side wall 204. The overcap 208 can include a top wall 332 and a side wall 334. In some embodiments, one or more vent holes 352 can be included to facilitate the release of steam. In some embodiments, vent holes can be disposed within the overcap 208. However, in other embodiments, vent holes can be disposed in other portions of the container 300.

In some embodiments, the side wall 104 of the inner cup is angled with respect to a vertical axis by 1 degrees to 20 degrees and the side wall 204 of the outer cover shell is angled with respect to a vertical axis by 1 degrees to 20 degrees. However, in other embodiments, one or both of side wall 104 of the inner cup 100 and the side wall 204 of the outer cover shell 200 can be substantially vertical in orientation. In various embodiments, the side wall 104 of the inner cup 100 is oriented parallel to the side wall 204 of the outer cover shell 200.

In some embodiments, the side wall 204 can include an outer wall 302 and an inner wall 304. In various embodiments, the outer wall 302 can be taller than the inner wall 304 and thus can overlap the inner wall vertically.

In this embodiment, there can be a gap 322 between the outer wall 302 and a side wall 104 of the inner cup 100. Similarly, the bottom wall 202 can include an outer wall 312 and an inner wall 314. There can be a gap 320 between the outer wall 312 and bottom wall 102 of the inner cup 100. In some embodiments, the disposable microwaveable container 300 can include support struts 350 at various locations to increase the structural integrity of the outer cover shell 200.

The size of the gaps can vary. In some embodiments, the bottom gap (e.g., the distance between the exterior of the bottom wall of the inner cup and the outer surface of the bottom wall of the outer cover shell) can be, on average or as measured at the horizontal middle of the bottom wall, at least about 0.01, 0.02, 0.03, 0.04, 0.05, 0.075, 0.1, 0.2, 0.3, 0.4, 0.5, or 0.75 inches, or can fall within a range between any of the foregoing. In some embodiments, the side gap (e.g., the distance between the exterior of the side wall of the inner cup and the exterior of the side wall of the outer cover shell) can be, on average or as measured at the vertical middle of the side wall, at least about 0.01, 0.02, 0.03, 0.04, 0.05, 0.075, 0.1, 0.2, 0.3, 0.4, 0.5, or 0.75 inches, or can fall within a range between any of the foregoing. In some embodiments, the top gap (e.g., the distance between the top surface of the top seal layer of the inner cup and the top surface of the top wall of the outer cover shell) can be, on average or as measured at the horizontal middle of the top seal layer, at least about 0.1, 0.2, 0.3, 0.4, 0.5, 0.6, 0.7, 0.8, 0.9, or 1.0 inches, or can fall within a range between any of the foregoing.

In some embodiments, the size of the gaps can be substantially uniform along the side wall, top wall and/or bottom wall. In other embodiments, the size of the gaps can vary along the walls. In some embodiments, the size the side wall gap is larger at the bottom of the side wall than at the top of the side wall. In other embodiments, the size of the side wall gap is larger at the top of the side wall than at the bottom of the side wall. In some embodiments, the top gap is larger than either the side wall gap or the bottom gap. In some embodiments, the ratio of the top gap to the side wall gap can be about 1.2:1 to about 6:1, or about 1.3:1 to about 2.5:1.

In various embodiments, the outer cover shell 200 can include a support structure for supporting the inner cup. The support structure can contact the inner cup and hold it in position. The support structure can take on various forms. For example, in some embodiments, the support structure can include an annular ledge 342. In some embodiments, the top of the inner cup 100 can include an outer flange 344 that can rest upon the annular ledge 342 when the inner cup 100 is positioned within the outer cover shell 200. The annular ledge 342 can be formed in various ways. In some embodiments, an annular support ledge is formed by a horizontal piece of material interconnecting the inner wall 304 and the outer wall 302 of the outer cover shell 200 side wall 204. In various embodiments, the outer cover shell 200 can include features that allow it to fold flat for easy shipping and handling and easy pop-up.

Figure 4:
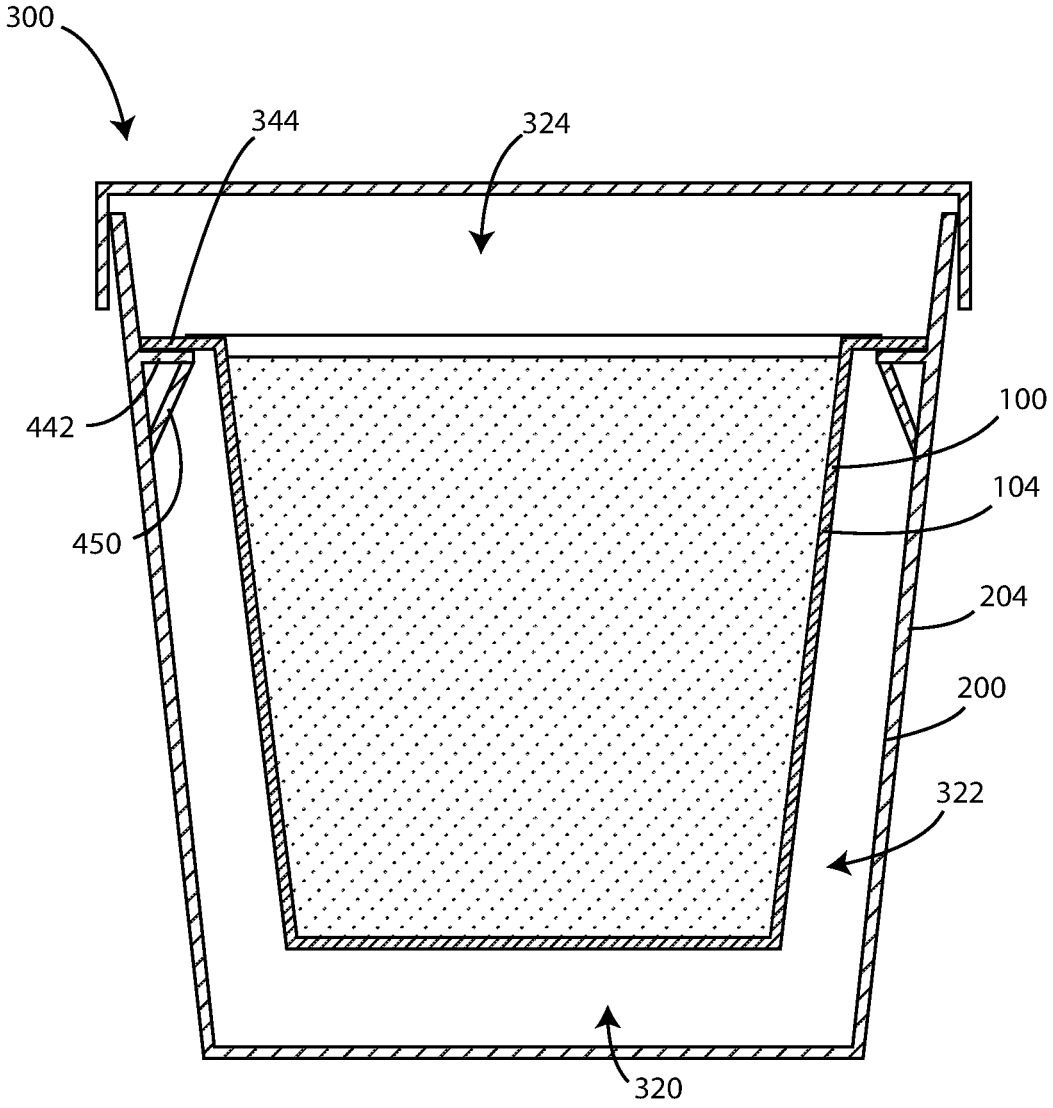
FIG. 4 is a schematic cross-sectional view of a disposable microwaveable container in accordance with various embodiments herein.

While the embodiment of a disposable microwaveable container shown in FIG. 3 shows a side wall including a dual side wall (e.g., an outer wall and an inner wall), it will be appreciated that single-wall embodiments are also included herein. Referring now to FIG. 4, a schematic cross-sectional view of a disposable microwaveable container 300 in accordance with various embodiments herein. The disposable microwaveable container 300 can include an inner cup 100 and an outer cover shell 200. The inner cup 100 can include a side wall 104. The outer cover shell 200 can include a single-wall side wall 204. In some embodiments, the top of the inner cup 100 can include an outer flange 344 that can rest upon a support ring 442 when the inner cup 100 is positioned within the outer cover shell 200. The support ring 442 can have a diameter that is narrower than a diameter of the top of the side wall of the inner cup 100 such that the support ring 442 suspends the inner cup 100 within the outer cover shell 200. In some embodiments, support features 450 (such as braces, struts, etc.) can be in contact with the support ring 442 in order to provide a desired level of rigidity and structural integrity to the support ring 442 so that it can support the weight of a filled inner cup 100. The container 300 can include gaps 320, 322 and 324 to provide protection to the inner cup 100 from the harsh conditions in the high-temperature oven.

Figure 5:
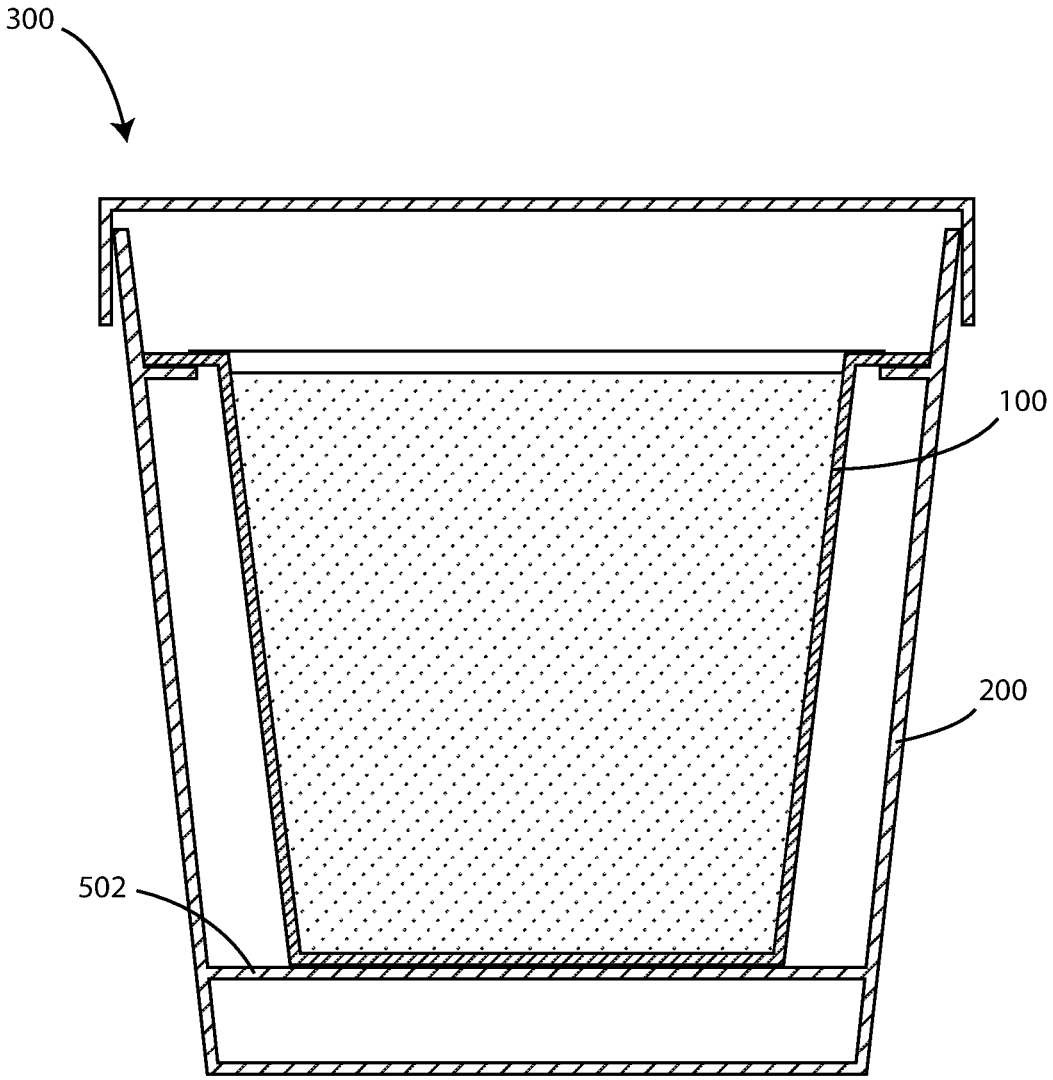
FIG. 5 is a schematic cross-sectional view of a disposable microwaveable container in accordance with various embodiments herein.
Figure 6:
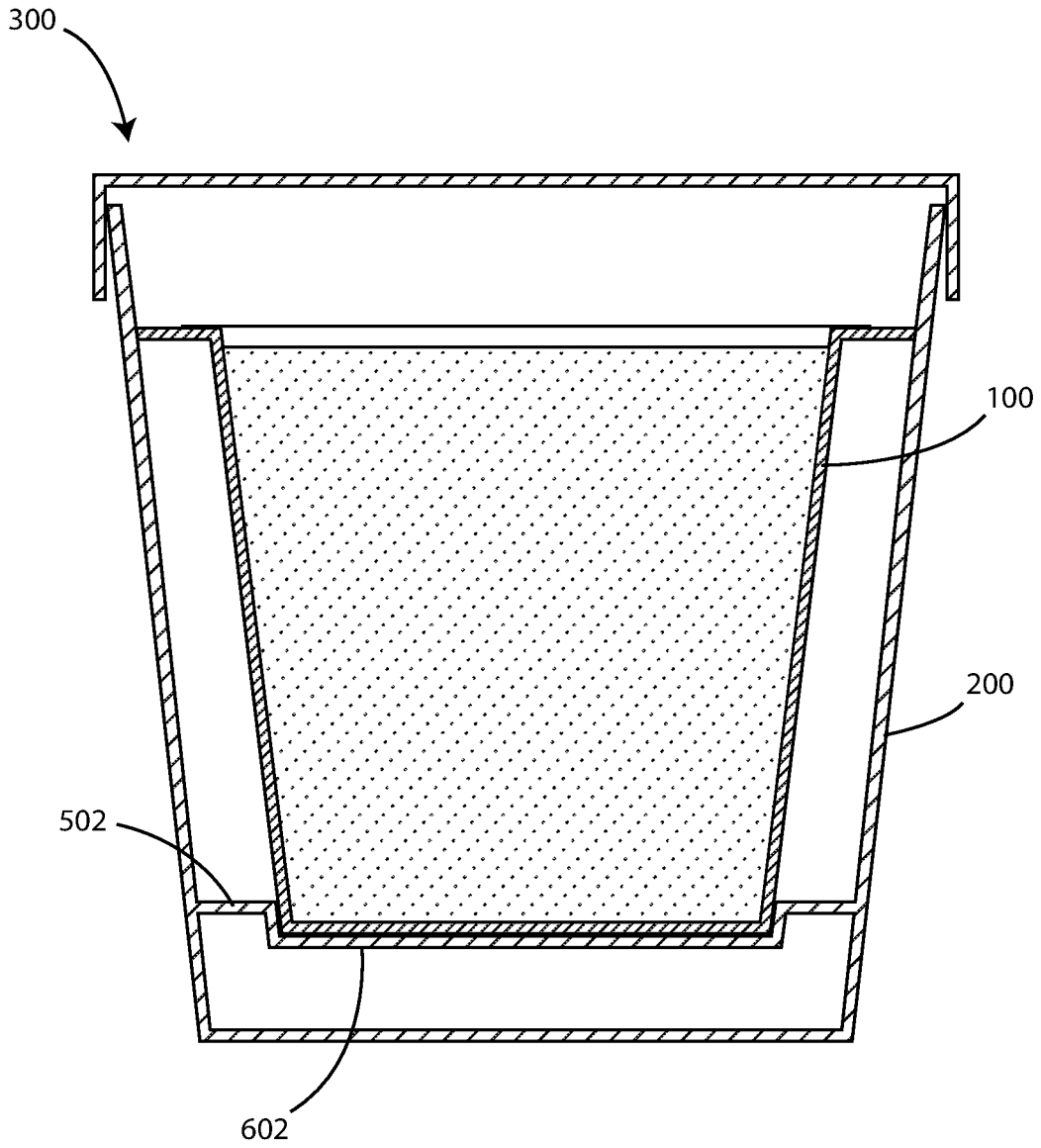
FIG. 6 is a schematic cross-sectional view of a disposable microwaveable container in accordance with various embodiments herein.

In some embodiments, the support structure for supporting the inner cup can take the form of a support shelf. Referring now to FIG. 5, a schematic cross-sectional view of a disposable microwaveable container 300 in accordance with various embodiments herein. The disposable microwaveable container 300 can include an inner cup 100 within an outer cover shell 200. A support shelf 502 can be disposed at the bottom of the inner cup 100. The inner cup 100 can be configured to rest on top of the support shelf 502. In some embodiments, the support shelf 502 can define a cavity into which a bottom portion of the inner cup 100 fits. Referring now to FIG. 6, a schematic cross-sectional view of a disposable microwaveable container 300 is shown in accordance with various embodiments herein. The disposable microwaveable container 300 can include an inner cup 100 within an outer cover shell 200. A support shelf 502 can be disposed at the bottom of the inner cup 100. The support shelf 502 can define a cavity 602 into which a bottom portion of the inner cup 100 fits.

Figure 7:
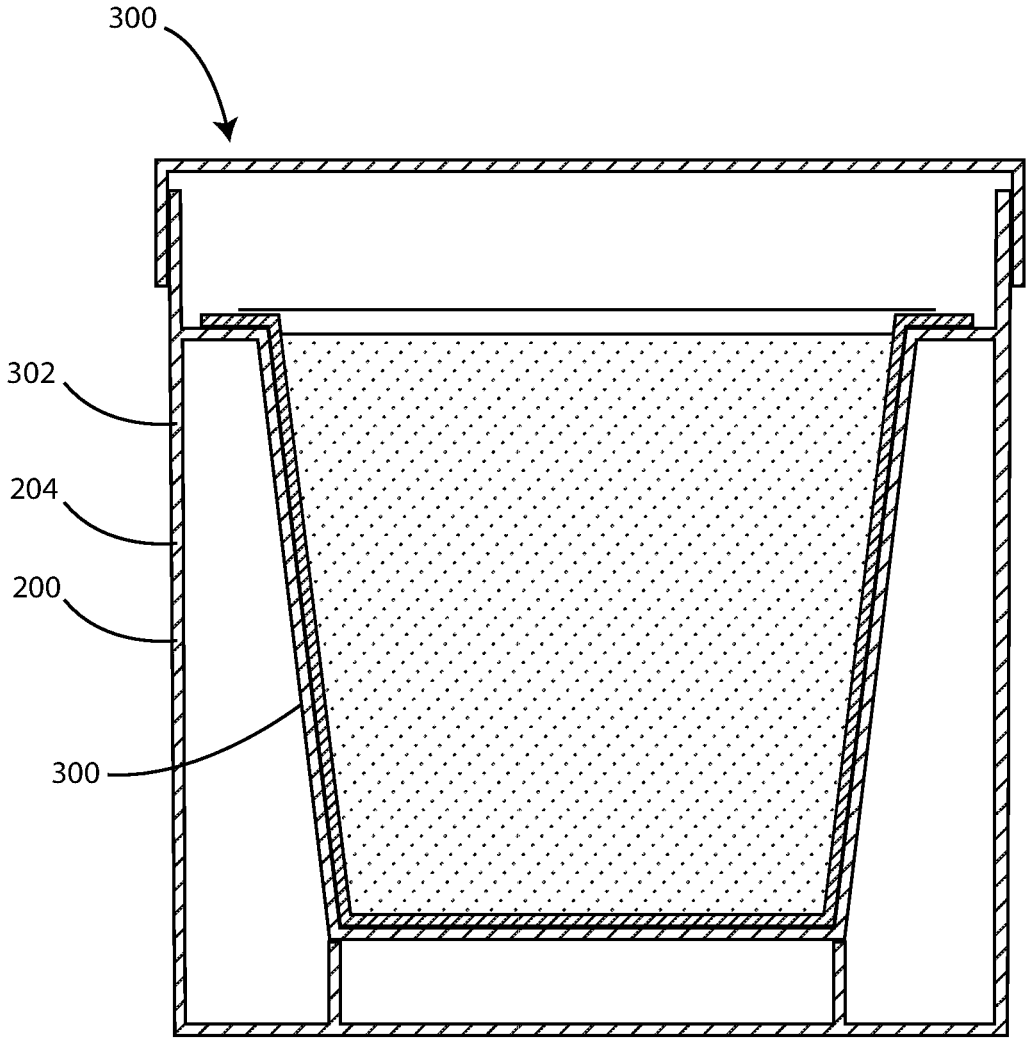
FIG. 7 is a schematic cross-sectional view of a disposable microwaveable container in accordance with various embodiments herein.

In various embodiments herein, the side walls of the inner cup 100 and the side walls of the outer cover shell 200 can be approximately parallel to one another. However, in other embodiments, they may not be parallel to one another. Referring now to FIG. 7, a schematic cross-sectional view of a disposable microwaveable container 300 in accordance with various embodiments herein. In this embodiment, the side wall 204 of the outer cover shell 200 can include an inner wall 304 that is angled with respect to a vertical axis and an outer wall 302 that is substantially parallel to a vertical axis.

In some embodiments, the disposable microwaveable food container an include a portion that can be removed to allow for removing the inner cup without having to contact potentially hot surfaces thereof. For example, the food container can include an inner platform box that can serve to hold the inner cup and the inner platform box can be removed from another portion of the product referred to as an outer box.

Figure 8:
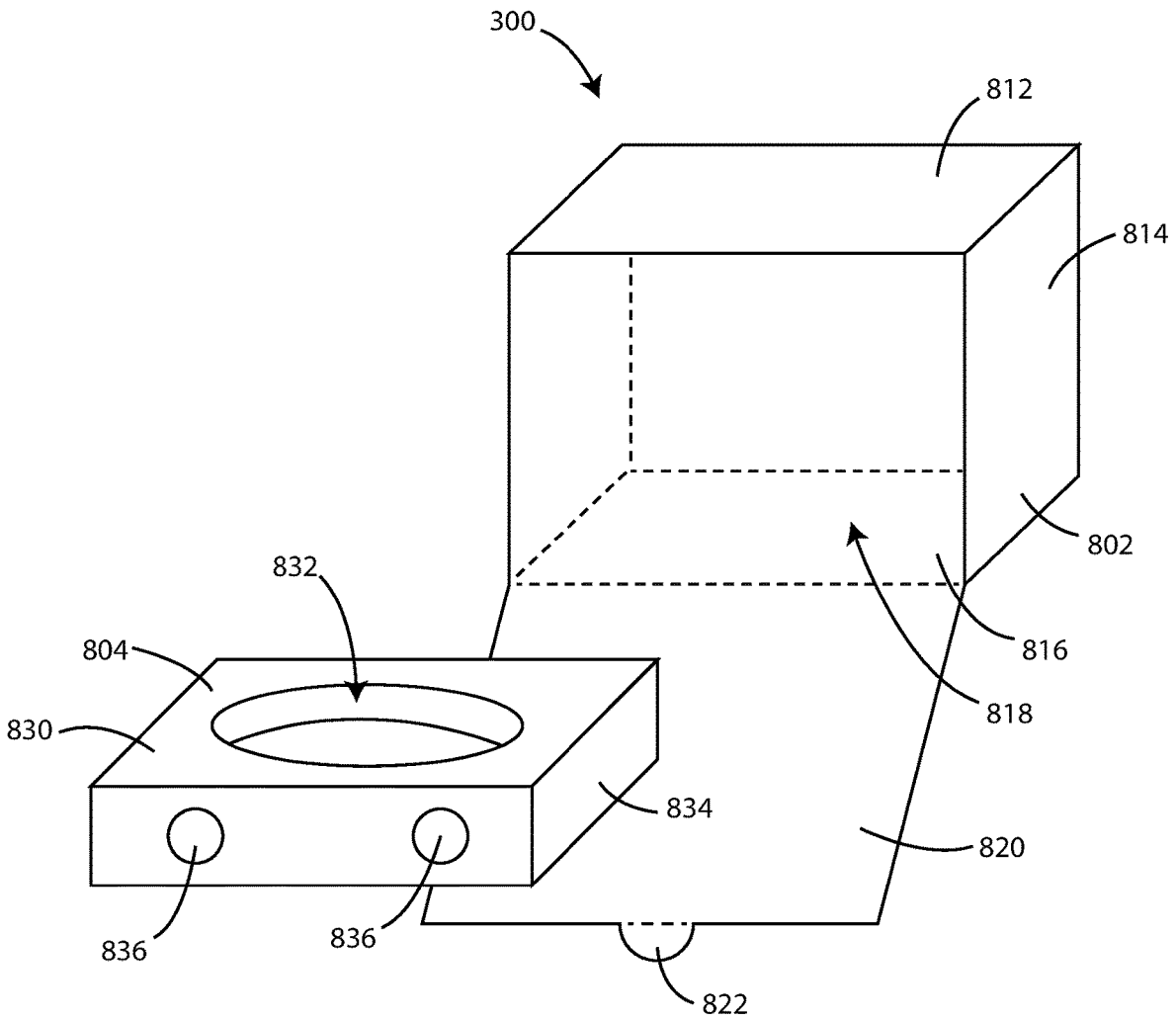
FIG. 8 is a schematic perspective view of a disposable microwaveable container in accordance with various embodiments herein.

Referring now to FIG. 8, a schematic perspective view of a disposable microwaveable container 300 in accordance with various embodiments herein. The disposable microwaveable container 300 can include an outer box 802 and an inner platform box 804. The outer box 802 can include a top wall 812, a side wall 814, a bottom wall 816, and a door 820 covering an openable aperture 818. In some embodiments, a connecting tab 822 can be connected to the door 820 in order to aid in holding the door 820 in position over the openable aperture 818 and/or providing a grip for a user to exert force to open the door 820. The inner platform box 804 can include a top wall 830 defining a cavity 832 which can receive a bottom portion of an inner cup. The inner platform box 804 can also include a side wall 834 and a bottom wall (not shown in this view). One or more finger holes 836 can be disposed in the side wall 834 in order to allow a user to grip the inner platform box 804 in order to slide it out from the outer box 802.

In some embodiments, such as those shown in FIGS. 3-7, the side wall of the outer cover shell can define an outer perimeter that is substantially circular. In some embodiments, the side wall of the outer cover shell can define an outer perimeter that is ovoid. In other embodiments, such as that shown in FIG. 8, the outer cover shell (including an outer box) can define an outer perimeter that is substantially polygonal, such as square. The perimeter of the side wall of the inner cup typically defines a circular perimeter, however other perimeter shapes including polygonal, square, ovoid and the like are also contemplated herein. Further it will be appreciated that while the walls shown in FIGS. 3-8 are substantially straight, curved or irregular walls are also explicitly contemplated herein including, but not limited to, walls with ridges, undulations, grips, and the like.

Inner Cup Materials

The bottom and side walls of the inner cup can be formed using various materials. By way of example, polymers such as polyolefins (e.g., polyethylenes, polypropylenes, and the like), polyesters, polycarbonates, polyvinylchlorides, polyethylene terephthalates (including, but not limited to, crystalline polyethylene terephthalate (CPET) and certain amorphous co-polyester of PET e.g., poly (1,4-cyclohexylenedimethylene terephthalate-co-isophthalate) (PCTA)), polyamides, and the like can be used to form the bottom and side walls of the inner cup. In various embodiments, other materials can be used in combination with one or more polymers, such as fillers including, but not limited to, mineral fillers such as talc, $CaCO_3$, mica), and the like. In various embodiments, multiple layers of polymers or other materials can be used. In various embodiments, the bottom and side walls of the inner cup can be formed for a polymeric material having a melting temperature and/or heat distortion temperature of less than 450, 425, 400, 375, 350, 325, 300, 275, 250 or 225 degrees Fahrenheit, of having a melting temperature falling within a range between any of the foregoing. In various embodiments, the bottom and side walls of the inner cup herein can contain substantially no metal content. Various techniques can be used to form the bottom and side walls of the inner cup including, but not limited to, thermoforming, injection molding, blow molding, and the like. The thickness of the bottom and the side walls of the inner cup can vary, but in some embodiments can be about 0.05, 0.1, 0.15, 0.2, 0.25, 0.3, 0.35, 0.4, 0.45, 0.5, 0.75, or 1 mm, or can fall within a range between any of the foregoing.

The seal layer of the inner cup can be formed using a peelable lidding film. The peelable lidding film can be a polymeric membrane. In some embodiments, the lidding film can specifically include a vent valve therein that can activate and release steam pressure inside the inner cup as the cooking/heating process takes pace to prevent spill or explosion of the food container. In some embodiments, the peelable lidding film can be applied upon manufacture of the lid using a cut-in-place application from a die cut heat and placement tool during a heat sealing process. The application can be performed on a liner transfer belt and vacuum wheel placement mechanism, or on an indexing line where the lid is stopped and the peelable lidding film is cut and placed on the recessed shelf of the lid.

In some embodiments, the heat sealing process can include applying the peelable lidding film by cutting, placing, and sealing all in the same operation. In some embodiments, the heat sealing process can include tack sealing the peelable lidding film off of a rotary system before moving on to a secondary sealing operation. In some embodiments, the peelable lidding film can be applied by an adhesive process. In some embodiments, the adhesive process can include applying a peelable, pressure-sensitive label having an adhesive coating at the outer perimeter and securing it to the lid by applying pressure to the outer perimeter. Exemplary sealing systems include, but are not limited to those offered by Rychiger, Ball Corporation, and Soudronic.

Outer Cover Shell Materials

The outer cover shell can be formed using various materials. In some embodiments, the outer cover shell or portions thereof can be formed of a fibrous cellulosic material. In some embodiments, the outer cover shell or portions thereof can be formed of a paperstock or cardstock material. In some embodiments, the outer cover shell or portions thereof can be formed of a solid bleached sulfate (SBS) paperboard. In some embodiments, the outer cover shell or portions thereof can be formed of a paperboard coated with at least one selected from the group consisting of kaolin clay, polyethylene resin and PET resin. In some embodiments, the outer cover shell or portions thereof can contain substantially no metal content (or lack metal content).

In some embodiments, the specific weight of the material used will be based on the strength/equivalent rigidity required by the physical configuration of the outer cover shell. In some embodiments, a weight of coated/uncoated 14 pt/16 pt can be used up to 24 or even 38 pts. In some embodiments, the outer cover shell or portions thereof can be formed of a non-corrugated paperboard or cardstock having a thickness of about 0.2 mm to 1 mm. In some embodiments, the outer cover shell can be cut from one or more sheets of material (such as die-cut, laser-cut, blade-cut or the like) and then folded and portions thereof attached together such as using an adhesive or the like.

Food Materials

Food materials herein can include, but are not limited to, soups, sauces, gravies, dips, salsas, dressings, dairy products, breakfast foods (including but not limited to oatmeal, corn hominy products, breakfast cereals), bakery products such as dough, bread, rolls, pizza, calzones, meat and meat products, mixed dishes such as pot pies, entrees, dry packaged dinners, shelf-stable dinners, lunches, side dishes, grains such as rice, wild rice *quinoa*, and the like, cereal products such as stuffing mixes and pasta, vegetables, fruits, legumes, snacks, desserts (including desserts that can be heated such as puddings, pies, cakes, and the like), hot beverages and the like. In some embodiments, the food material herein can have a relatively high moisture content. In various embodiments, the food material herein has a moisture content of greater than 20, 30, 40, 50, 60, 70, 80, 90, 95, or 98 percent by weight. In some embodiments, the food material can have a moisture content falling within a range between any of the foregoing. In some embodiments, the food material can be a low acid food product. In some embodiments, the food material can have a pH of greater than 4.6. In some embodiments, the food material can have a pH of 4.6 or lower. In some embodiments the food material can be a flowable food material. The amount of the food material can vary. In some embodiments, 10, 20, 30, 40, 50, 75, 100, 150, 200, 300, 400, 500, 750, 1000, 1500, or 2000 grams of a food material can be used in an individual container (such as the inner cup). In some embodiments, the amount of the food material can fall within a range between any of the foregoing.

Vent Valves

In various embodiments, the top seal layer which serves to seal the food material into the inner cup can include a vent valve or one-way valve in order to release pressure and steam which can build up during the cooking/heating process. In some embodiments, the top seal layer includes a valve configured to open under pressure through movement of at least a portion of the valve along a vertical axis. Many different valve constructions can be used. Exemplary valves are described in U.S. Pat. Nos. 5,263,777; 7,051,762; and 9,199,781; the content of which directed to valves is herein incorporated by reference.

Figure 9:
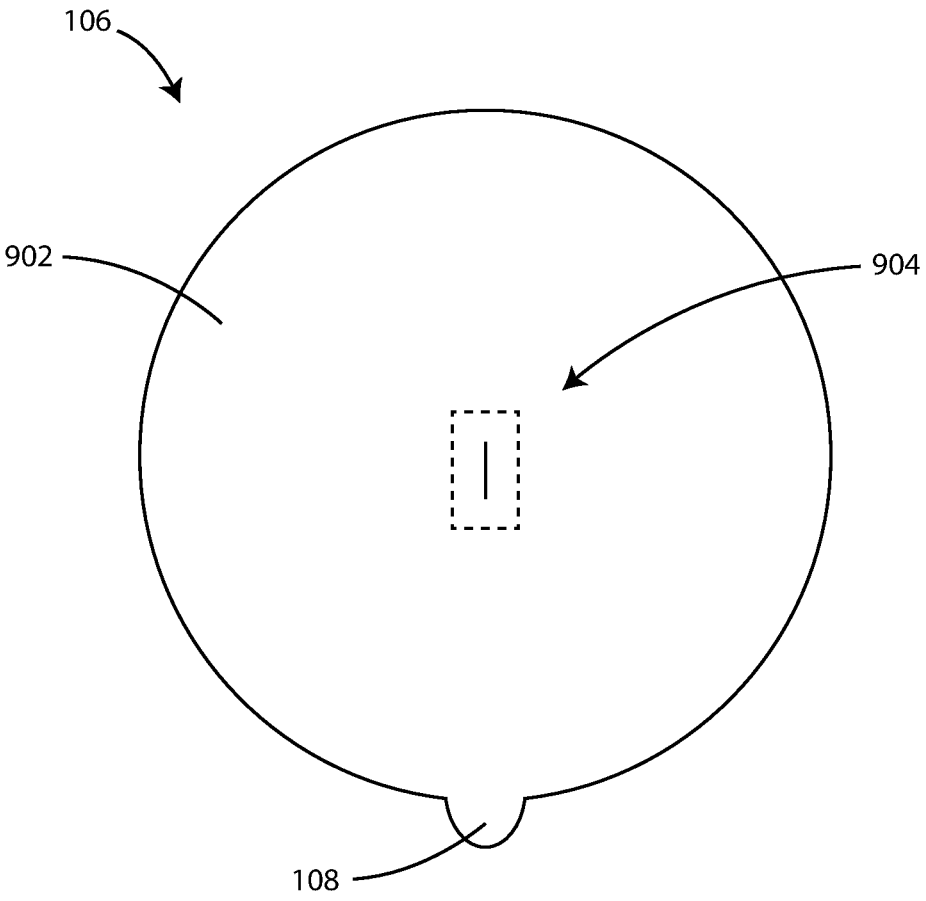
FIG. 9 is a schematic plan view of a top seal layer in accordance with various embodiments herein.

Referring now to FIG. 9, schematic view is shown of a top seal layer 106 including a vent valve 904 and a peel tab 108. The top seal layer 106 can be formed of a polymeric lidding film 902.

Methods

Various methods are included herein. In some embodiments, a method of making a microwaveable food product for high-temperature cooking applications is included. The method can include placing food material such as those described above into an inner cup such as those described above. Various amounts (weights/volumes) of food materials can be put into each container. In some embodiments the amount can be from about 25 ml (or 25 grams) to about 3 liters (or 3 kilograms). The method can also include applying a lidding film, such as a peelable lidding film, a top surface of the inner cup to seal the food material into the inner cup. In some embodiments, the method can include applying the lidding film while applying a vacuum, such that there is a negative pressure in the head space of the sealed and filled inner cup.

The method can further include placing the filled inner cup into an outer cover shell such as those described above. In some embodiments, the method can include placing the filled inner cup into an inner platform box (such as those described above) and inserting the inner platform box into an outer box (such as those described above). In some embodiments, the method can further include a step of applying an overwrap film around the outside of the outer cover shell (wherein the overwrap film may be removed prior to a heating/cooking operation).

In some embodiments, a method of preparing a microwaveable food product is included herein. The method can include inserting a microwaveable food product including an inner cup (described above), a food material (described above) within the inner cup, and an outer cover shell (described above) into a high-temperature, high-speed cooking oven. In some embodiments, the high-temperature, high-speed can be one that heats using both microwave energy and convection. In some embodiments, the method can include raising the temperature to at least 400, 425, 450, 475, 500, 525, or 550 degrees Fahrenheit (or a temperature falling within a range between any of the foregoing) in less than 45, 30, 20, 15, 10, or 5 seconds after inserting the microwaveable food product into the cooking oven and initiating the cooking cycle (such as automatically such as by closing a door or manually by actuating a button). In some embodiments, the method can include holding the temperature at at least 400, 425, 450, 475, 500, 525, or 550 degrees Fahrenheit (or at a temperature falling within a range between any of the foregoing) for a hold time of at least 5, 10, 15, 20, 30, 40, 50, 60, 75, 90, or 120 seconds (or for a time falling within a range between any of the foregoing) with the food product in the cooking oven. In some embodiments, the method can include removing the food product from the cooking oven. In some embodiments, the method can include opening the outer cover shell and removing the inner cup therefrom. In some embodiments, the method can include opening an outer box (which can be a part of the outer cover shell) and removing an inner platform box holding the inner cup therefrom.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A disposable microwaveable food container for high-temperature cooking applications comprising:

an inner cup comprising a bottom wall, a side wall connected to the bottom wall, the side wall comprising a top, a top seal layer in contact with the top of the side wall;

the bottom wall and side wall together defining a reservoir to hold a food material to be heated; and an outer cover shell, the outer cover shell comprising a bottom wall, a side wall connected to the bottom wall;

a top wall connected the side wall;

a support structure for supporting the inner cup, the support structure comprising a support shelf, the support shelf contacting the inner cup and holding it in a position with a bottom gap of at least 0.05 inches between the bottom wall of the inner cup and the bottom wall of the outer cover shell;

a side gap of at least 0.05 inches between the side wall of the inner cup and the side wall of the outer cover shell; and a top gap of at least 0.3 inches between the top seal layer of the inner cup and the top wall of the outer cover shell;

wherein the support shelf extends from the side wall of the outer cover shell and the inner cup is configured to rest on top of the support shelf;

wherein the support shelf defines a cavity into which a bottom portion of the inner cup fits.

2. The disposable microwaveable food container of claim 1, the support structure comprising a support ring having a diameter that is narrower than a diameter of the top of the side wall of the inner cup such that the support structure suspends the inner cup within the outer cover shell.

3. The disposable microwaveable food container of claim 2, the support ring comprising an annular ledge.

4. The disposable microwaveable food container of claim 3, a top of the inner cup comprising an outer flange, wherein the outer flange rests upon the annular ledge when the inner cup is positioned within the outer cover shell.

5. The disposable microwaveable food container of claim 1, wherein the outer cover shell comprises a bottom portion and a top portion, wherein the top portion is separable from the bottom portion.

6. The disposable microwaveable food container of claim 1, wherein the outer cover shell comprises at least one of a fibrous cellulosic material;

a solid bleached sulfate (SBS) paperboard;

a paperboard coated with at least one selected from the group consisting of kaolin clay and polyethylene resin; and a non-corrugated paperboard having a thickness of 0.3 mm to 1 mm.

7. The disposable microwaveable food container of claim 1, wherein the outer cover shell lacks metal content.

8. The disposable microwaveable food container of claim 1, wherein the inner cup comprises a polymeric material having a melting temperature of less than 300 degrees Fahrenheit.

9. The disposable microwaveable food container of claim 1, wherein the side wall of the inner cup is angled with respect to a vertical axis by 2 degrees to 15 degrees and the side wall of the outer cover shell is angled with respect to a vertical axis by 2 degrees to 15 degrees.

10. The disposable microwaveable food container of claim 1, wherein the side wall of the inner cup is oriented parallel to the side wall of the outer cover shell.

11. The disposable microwaveable food container of claim 1, wherein the top seal layer comprises a valve configured to open under pressure through movement of at least a portion of the valve along a vertical axis.

12. The disposable microwaveable food container of claim 1, further comprising a plastic overwrap disposed over the outer cover shell that is configured to be removed before product heating.

13. The disposable microwaveable food container of claim 1, wherein the insulative properties provided by the bottom gap, side gap, and top gap are sufficient so as to prevent damage to the inner cup despite exposure of the outer cover shell to an air temperature of at least about 450 degrees Fahrenheit for at least 30 seconds.

14. The disposable microwaveable food container of claim 1, wherein the top wall of the outer cover shell is formed by an overcap configured to fit over a top of the side wall of the outer cover shell.

15. A method of making a microwaveable food product for high-temperature cooking applications comprising:

placing food material into an inner cup, the inner cup comprising a bottom wall, a side wall connected to the bottom wall, the side wall comprising a top, the bottom wall and side wall together defining a reservoir;

applying a lidding film to a top surface of the inner cup to seal the food material into the inner cup, wherein the lidding film is in contact with the top of the side wall;

placing the filled inner cup into an outer cover shell, the outer cover shell comprising a bottom wall, a side wall connected to the bottom wall;

a top wall connected the side wall; and a support structure for supporting the inner cup, the support structure comprising a support shelf, the support shelf contacting the inner cup and holding it in a position with a bottom gap of at least 0.05 inches between the bottom wall of the inner cup and the bottom wall of the outer cover shell;

a side gap of at least 0.05 inches between the side wall of the inner cup and the side wall of the outer cover shell; and a top gap of at least 0.3 inches between the lidding film of the inner cup and the top wall of the outer cover shell;

wherein the support shelf extends from the side wall of the outer cover shell and the inner cup is configured to rest on top of the support shelf;

wherein the support shelf defines a cavity into which a bottom portion of the inner cup fits.

16. A method of preparing a microwaveable food product comprising inserting a microwaveable food product into a high-temperature, high-speed cooking oven, the microwaveable food product comprising an inner cup comprising a bottom wall, a side wall connected to the bottom wall, the side wall comprising a top, a top seal layer in contact with the top of the side wall;

the bottom wall and side wall together defining a reservoir;

a food material disposed within the inner cup; and an outer cover shell comprising a bottom wall, a side wall connected to the bottom wall;

a top wall connected the side wall;

a support structure for supporting the inner cup, the support structure comprising a support shelf, the support shelf contacting the inner cup and holding it in a position with a bottom gap of at least about 0.05 inches between the bottom wall of the inner cup and the bottom wall of the outer cover shell;

a side gap of at least 0.05 inches between the side wall of the inner cup and the side wall of the outer cover shell;

a top gap of at least 0.3 inches between the top seal layer of the inner cup and the top wall of the outer cover shell; and wherein the support shelf extends from the side wall of the outer cover shell and the inner cup is configured to rest on top of the support shelf, the support shelf defines a cavity into which a bottom portion of the inner cup fits;

raising a temperature in the cooking oven to at least 500 degrees Fahrenheit in less than 10 seconds after inserting the microwaveable food product into the cooking oven and initiating a cooking cycle;

holding the temperature at no less than 500 degrees Fahrenheit for a hold time of at least 20 seconds; and removing the food product from the cooking oven.

* * * * *